US010538084B2

(12) United States Patent
Kodoi et al.

(10) Patent No.: US 10,538,084 B2
(45) Date of Patent: Jan. 21, 2020

(54) INK EJECTION HEAD

(71) Applicant: CANON KABUSHIKI KAISHA, Tokyo (JP)

(72) Inventors: Takuma Kodoi, Kawasaki (JP); Takuya Iwano, Inagi (JP); Takamitsu Tokuda, Tokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,339

(22) Filed: Jun. 29, 2018

(65) Prior Publication Data

US 2019/0009533 A1 Jan. 10, 2019

(30) Foreign Application Priority Data

Jul. 5, 2017 (JP) ..... 2017-131776

(51) Int. Cl.
*B41J 2/14* (2006.01)
*B41J 2/045* (2006.01)
*B41J 2/15* (2006.01)

(52) U.S. Cl.
CPC ..... *B41J 2/14* (2013.01); *B41J 2/04541* (2013.01); *B41J 2/04586* (2013.01); *B41J 2/15* (2013.01); *B41J 2002/14491* (2013.01)

(58) Field of Classification Search
CPC ... B41J 2/14; B41J 2/15; B41J 2/04541; B41J 2/04586; B41J 2002/14491; B41J 2002/14362; B41J 2/175
See application file for complete search history.

(56) References Cited

U.S. PATENT DOCUMENTS 8,419,167 B2 4/2013 Miyazaki et al.
9,238,361 B2 1/2016 Muraoka et al.
9,832,864 B2 11/2017 Iri et al.
9,884,485 B2 2/2018 Yoshikawa et al.
2016/0089879 A1* 3/2016 Tanaka ..... B41J 2/04541 347/10
2017/0326875 A1 11/2017 Nakakubo et al.
2019/0001674 A1* 1/2019 Ishimatsu ..... B41J 2/14024

FOREIGN PATENT DOCUMENTS

EP 3421246 * 1/2019 ..... B41J 2/14024
JP 2011-240519 A 12/2011
JP 2012-091510 A 5/2012
JP 2013223987 * 10/2013 ..... B41J 3/04

OTHER PUBLICATIONS

Google translation of JP 2013-223987, published on Oct. 2013 (Year: 2013).*
U.S. Appl. No. 16/006,297, Shin Ishimatsu, Toshiaki Hirosawa, Genji Inada, Hiromasa Amma, Shogo Kawamura, Yasuhiko Osaki, Takuya Iwano, filed Jun. 12, 2018.

* cited by examiner

*Primary Examiner* — Huan H Tran
(74) *Attorney, Agent, or Firm* — Venable LLP

(57) ABSTRACT

A liquid ejection head includes an element substrate for ejecting a liquid, an integrated circuit board outputting a control signal for controlling the element substrate, and an electrical wiring board connected electrically to the element substrate. The electrical wiring board has a signal line connector to which control signals are inputted and electrical wiring board connectors to which an electric signal for driving the liquid ejection head is inputted. The signal line connector and the electrical wiring board connectors are disposed on opposite sides to each other relative to a center line extending orthogonally to a longitudinal direction of the electrical wiring board.

14 Claims, 12 Drawing Sheets

INK EJECTION HEAD

BACKGROUND OF THE INVENTION

Field of the Invention

The present disclosure relates to an ink ejection head for ejecting a liquid.

Description of the Related Art

As an ink ejection apparatus, a serial type and a page-wide type are known. In the serial type, recording operation is performed while moving a carriage on which a liquid ejection head is mounted. In the page-wide type, a liquid ejection head having a size corresponding to a width of a recording medium is secured, and a recording operation is performed while conveying the recording medium. The liquid ejection apparatus of the page-wide type can perform high speed recording, since it can perform recording simultaneously on a broader area than that of the serial type.

In order to realize high speed recording, it is required to process control signals for controlling a liquid ejection head, which are inputted from the body of the liquid ejection apparatus, at high speed. In order to perform such high speed processing of control signals, some liquid ejection heads are provided with an integrated circuit such as an application-specific integrated circuit (ASIC) for processing a control signal. See, e.g., Japanese Patent Application Laid-Open No. 2011-240519 and Japanese Patent Application Laid-Open No. 2012-91510.

In recent years, a liquid ejection apparatus of a page-wide type allows not only high speed recording, but also high definition image formation. Therefore, it is required to perform higher speed ejection of liquid. As a result, it is required to achieve higher clock frequency of the integrated circuit mounted in a liquid ejection head.

However, as clock frequency is made higher, control signals may be easily influenced by noise. Therefore, the waveform of the control signals is disturbed, and as a result, a risk of influencing the discharge of liquid is increased. For example, if other wiring lines are placed in the vicinity of a signal line transmitting control signals including recording data and clock, the waveform of the control signals may be disturbed. Especially, in a case where other wiring lines are high electric potential wiring lines transmitting electric signals of higher electrical potential than recording data clock, etc., in control signals, the signal waveform of the control signals may greatly be disturbed due to fluctuation of the power supply signal at the time of startup.

SUMMARY OF THE INVENTION

An object of the present disclosure is to provide a liquid ejection head enabling the reduction of the influence of noise on control signals. The liquid ejection head of the present disclosure is characterized by including an element substrate for ejecting a liquid, an integrated circuit board including an integrated circuit configured to output a control signal for controlling the element substrate and an electrical wiring board connected electrically to the element substrate, wherein the electrical wiring board includes a signal input section to which the control signal is inputted and a power input section to which an electric signal for driving the liquid ejection head is inputted, and wherein the signal input section and the power input section are disposed on opposite sides to each other relative to a center line extending orthogonally to a longitudinal direction of the electrical wiring board.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings. Note that, the parts having the same functions are identified using the same symbols, and the explanations thereof may be omitted.

The First Embodiment

Figure 1:
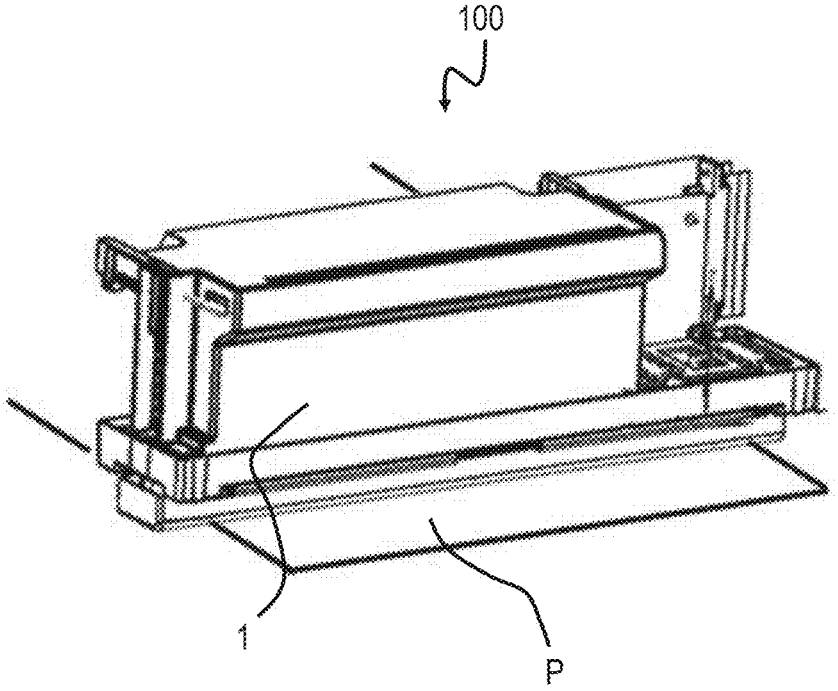
FIG. 1 is a perspective view for illustrating a liquid ejection apparatus according to the first embodiment of the present disclosure.

FIG. 1 is a perspective view for illustrating a liquid ejection apparatus according to the first embodiment of the present disclosure. The liquid ejection apparatus 100 is a recording apparatus of a page-wide type (line type) which performs recording with one pass while conveying continuously or intermittingly the recording medium P. The liquid ejection apparatus 100 comprises a conveyance section (not shown) for conveying the recording medium P, and a liquid ejection head 1 disposed so as to be substantially orthogonal to the conveyance direction of the recording medium P. The liquid ejection head 1 has the size corresponding to the width of the recording medium P (the length in the direction substantially orthogonal to the conveyance direction). In the present embodiment, the liquid ejection head 1 makes possible to perform full color printing by ejecting the inks of CMYK (Cyan Magenta Yellow Black) as a liquid.

Figure 2:
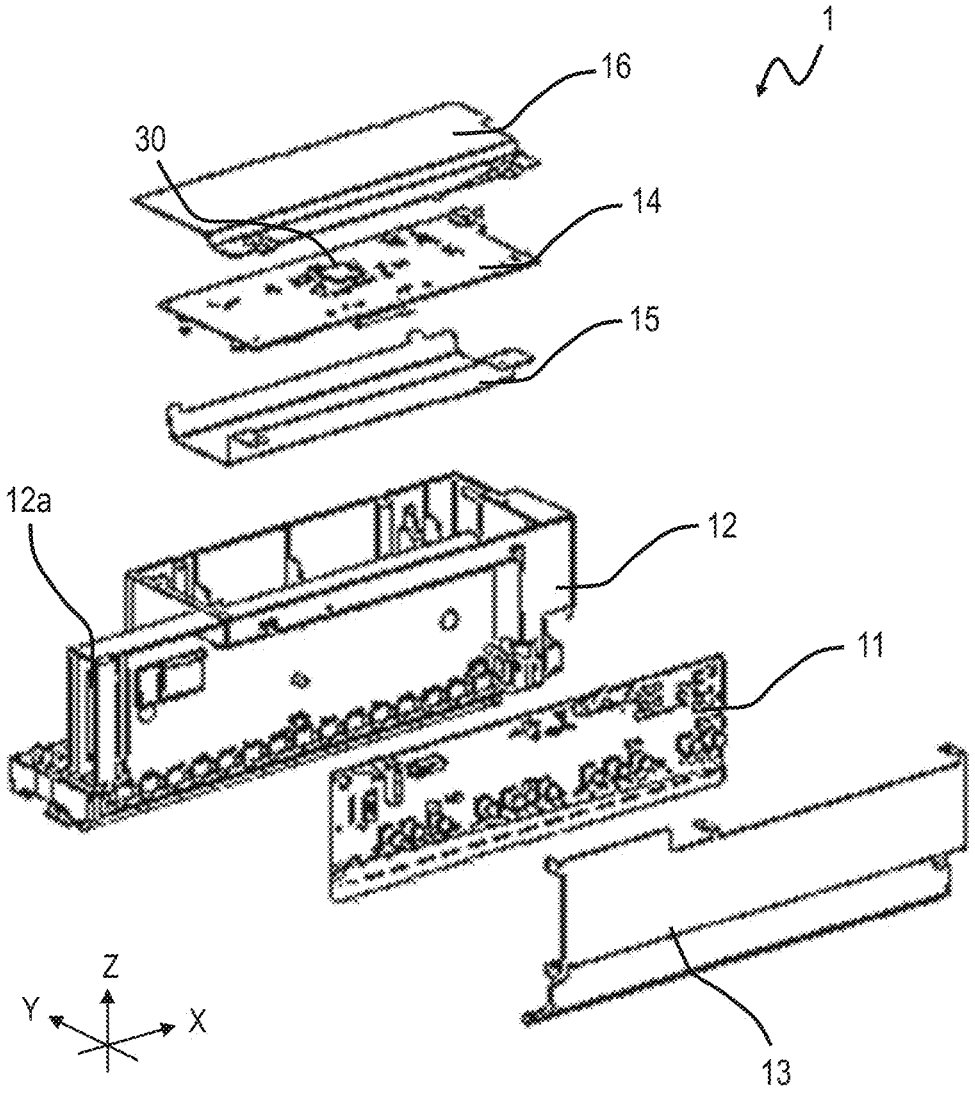
FIG. 2 is an exploded perspective view for illustrating a liquid ejection head according to the first embodiment of the present disclosure.
Figure 3:
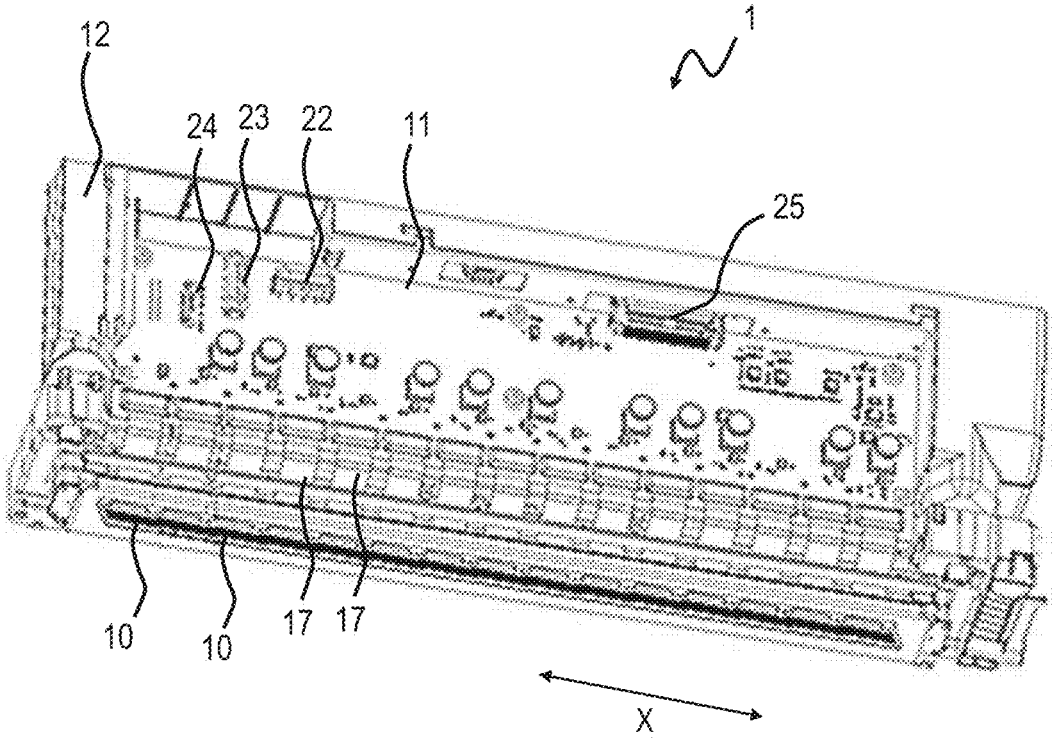
FIG. 3 is a perspective view of the liquid ejection head according to the first embodiment of the present disclosure viewed obliquely from the bottom.

FIGS. 2 and 3 are views for illustrating the structures of the liquid ejection head 1. FIG. 2 is an exploded perspective view for illustrating the liquid ejection head 1. FIG. 3 is a perspective view of the liquid ejection head 1 viewed obliquely from the bottom. As shown in FIGS. 2 and 3, the liquid rejection head includes a plurality of element substrates 10 for ejecting a liquid, an electrical wiring board 11 connected electrically to the element substrates 10, a support member 12 supporting the electrical wiring board 11, and protective sheet metal 13 for protecting the electrical wiring board 11. The protective sheet metal 13 is attached to the support member 12 so as to cover the electrical wiring board 11. (In FIG. 3, the above structure is not concretely shown.). In the liquid ejection head 1 of the page-wide type, a plurality of element substrates 10 are arranged on a straight line (in line).

A plurality of the element substrates 10 are disposed on the bottom of the support member 12, and are arranged in line along a longitudinal direction of the support member 12. The whole length of a plurality of the element substrates 10 is equal to or greater than the width of the recording medium P. In this embodiment, the longitudinal direction of the support member 12 is oriented in the X direction, which is a substantially horizontal direction.

The element substrate 10 comprises an ejection orifice (not shown) for ejecting a liquid, a pressure chamber (not shown) for storing a liquid to be ejected, and an energy generation element (not shown) generating energy for ejecting a liquid. In this embodiment, the energy generation element is a heater. The element substrate 10 also comprises a sub-heater (not shown) for controlling a temperature of the element substrate 10.

Each of the element substrates 10 is electrically connected to a flexible wiring board 17. Each of the flexible wiring boards 17 is electrically connected to the electrical wiring board 11. Therefore, the electrical wiring board 11 is electrically connected to a plurality of element substrates 10 via the corresponding flexible wiring boards 17.

The electrical wiring board 11 is arranged on a different face of the support member 12 from the face on which the element substrates 10 are disposed. In this embodiment, the electrical wiring board 11 is arranged on the side face of the support member 12. The longitudinal direction of the electrical wiring board 11 is oriented in the X direction, and the transverse direction of the electrical wiring board 11 is oriented in the Z direction which is the substantially perpendicular direction. Note that, FIG. 3 shows electrical wiring board connectors 22, 23 and 24 and a signal line connector 25 which are provided on the electrical wiring board 11. (Details thereof will be described later.)

Disposed in the support member 12 is a connector support section 12*a* for supporting the electrical input member (FIG. 6), which has a connector (FIG. 6) arranged for inputting electrical signals for operating the liquid ejection head from the body of the liquid ejection apparatus 100.

Further, the liquid ejection head 1 has an integrated circuit board 14 including an integrated circuit 30 for controlling the element substrates 10, and protective sheet metals 15 and 16 for protecting the integrated circuit board 14. The integrated circuit board 14 outputs control signals for controlling the element substrates 10 generated by the integrated circuit 30 to the electrical wiring board 11. The control signals include logic signals for controlling ejection of a liquid by the element substrates 10. Further, the control signals may include other signals such as a signal for controlling a temperature of the element substrates 10, besides the logic signals. As the integrated circuit 30, an application specific integrated circuit is preferred. However, general purpose integrated circuits may also be used. In the embodiment of the figure, the integrated circuit board 14 is arranged so as to be substantially parallel to the face on which the element substrates 10 are disposed and substantially orthogonal to the electrical wiring board 11. The integrated circuit board 14 is disposed on the face of the support member 12 located on the opposite side to the face on which the element substrates 10 are disposed.

By disposing the integrated circuit 14 as described above, it is possible to suppress upsizing of the liquid ejection head 1. More specifically, it is possible to downsize the liquid ejection head 1 in the height direction (Z direction) and in the depth direction (Y direction). As a result, the degree of freedom in designing the liquid ejection apparatus 100 is improved. Especially, in case of mounting a unit such as a scanner in the upper portion of the liquid rejection apparatus 100, downsizing in the height direction is important. Therefore, it is desired that the integrated circuit board 14 is arranged as shown in the figures. Note that, the longitudinal direction of the integrated circuit board 14 is oriented in the X direction, and the transverse direction of the integrated circuit board 14 is oriented in the Z direction that is substantially orthogonal to both the X and Y directions.

The electrical wiring board 11 and the integrated circuit board 14 are a multilayer substrate made of a plurality of layers. In this embodiment, a four-layer substrate made of four layers is used as the electrical wiring board 11 and the integrated circuit substrate 14.

The protective sheet metals 15 and 16 cover different surfaces of the integrated circuit board 14, respectively. In the embodiment as shown in the figures, the protective sheet metal 15 covers the lower surface (rear surface), while the protective sheet metal 16 covers the upper surface (front surface). The protective sheet metal 15 is mounted on the support member 12 so that the surface opposite to the surface facing (the lower surface of) the integrated circuit board 14 faces the support member 12. Thus, the integrated circuit board 14 is mounted on the support member 12 through the protective sheet metal 15.

Note that, the liquid ejection head 1 may mount other parts such as a sub-tank for temporarily storing a liquid and a head cover for protecting the element substrate 10, besides the above component parts. (Explanations of them are omitted here.)

Figure 4:
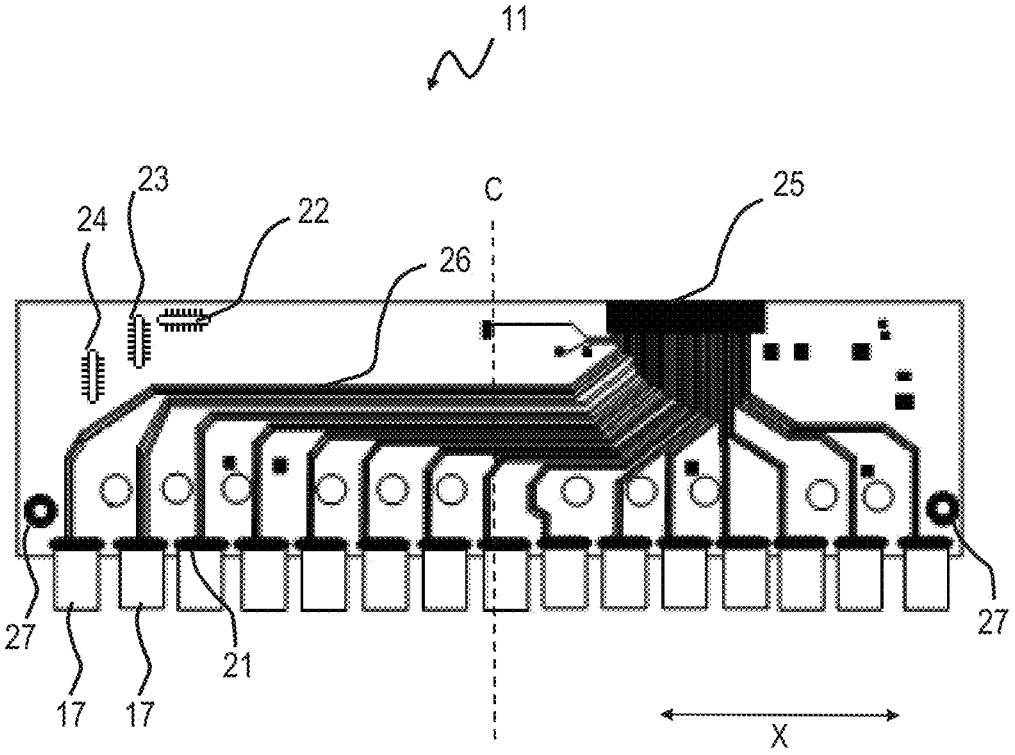
FIG. 4 is a plan view for illustrating an electrical wiring board according to the first embodiment of the present disclosure.

FIG. 4 is a plan view for illustrating more in detail the structure of the electrical wiring board 11. As shown in FIG. 4, the electrical wiring board 11 has the wiring connection section 21 electrically connected to the flexible wiring board 17. The wiring connection section 21 is sealed by wedge bonding or the like after electrically connecting to the flexible wiring board 17.

Further, the electrical wiring board 11 has the electrical wiring board connectors 22-24 which form a power input section to which electric signals for driving the liquid rejection head 1 are inputted from the body of the liquid ejection apparatus 100, and the signal line connector 25 for inputting and outputting signals with the integrated circuit board 14. The signal line connector 25 functions as a signal input section to which control signals are inputted from the integrated circuit board 14. Further, the electrical wiring board 11 has screw holes 27 for grounding the electrical wiring board 11 via screws (not shown).

The electrical wiring board connectors 22-24 are disposed on the side of the electrical input member (not shown), supported by the connector support section 12*a*, relative to the center line C orthogonal to the X direction which is the longitudinal direction of the electrical wiring board 11. The signal line connector 25 is disposed on the other side than the side of the connector and the electrical wiring connectors 22-24 relative to the center line C. The signal line connector 25 is electrically connected to wiring connection sections 21 via signal lines 26. The signal lines 26 transmit control signals inputted to the electrical wiring board 11 to the flexible wiring boards 17.

Figure 5A:
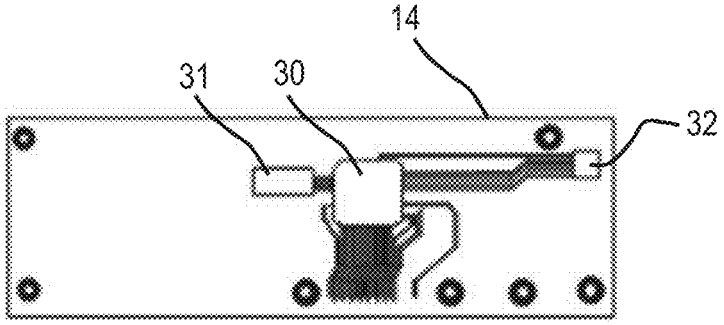
FIG. 5A is a plan view for illustrating an integrated circuit board according to the first embodiment of the present disclosure.
Figure 5B:
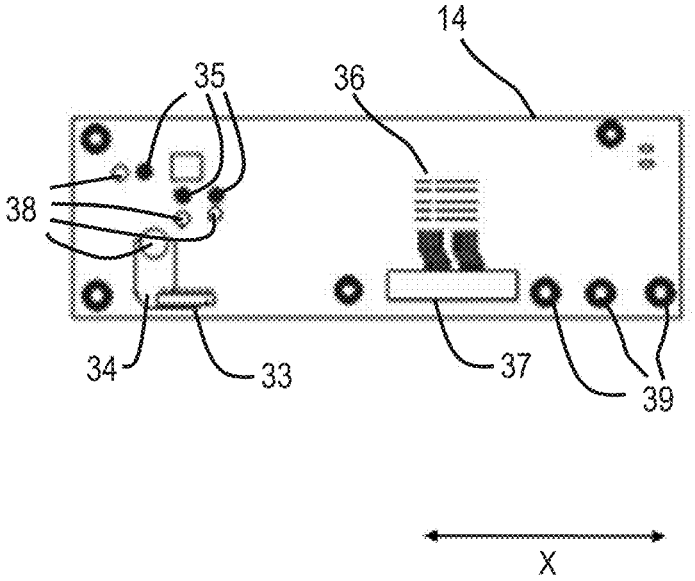
FIG. 5B is a plan view for illustrating an integrated circuit board according to the first embodiment of the present disclosure.

FIGS. 5A and 5B are plan views for illustrating more in detail the structure of the integrated circuit board 14. Specifically, FIG. 5A shows the front surface (upper surface) of the integrated circuit board 14, and FIG. 5B shows the back surface (bottom surface) of the same.

As shown in FIG. 5A, an integrated circuit 30 and a memory 31 electrically connected to the integrated circuit 31 are arranged on the front surface of the integrated circuit board 14. Further, arranged on the front surface of the integrated circuit board is an HDMI (High-Definition Multimedia Interface) connector 32 for inputting and outputting signals with the body of the liquid ejection apparatus 100. The HDMI connector 32 functions as an external input section, to which external control signals as control signals for controlling the element substrate 10 from the body of the liquid ejection apparatus 100 are inputted.

Further, as shown in FIG. 5B, an integrated circuit board connector 33, a high potential wiring line 34, DC/DC converters 35, a group of through holes 36 and a signal line connector 37 are arranged on the rear surface of the integrated circuit board 14. Further, the integrated circuit board 14 may have other circuit elements such as electrolytic capacitors 38 or the like.

The integrated circuit substrate connector 33 is a connection section for inputting first electrical signals as high potential electric signals from the electrical wiring board 11. The first electrical signals are described in detail later. The high potential electrical wiring line 34 is a wiring line for transmitting the first electric signals inputted to the integrated circuit board connector 33. The high potential electrical wiring as shown in the figure is a portion of wiring lines electrically connecting the integrated circuit board connector 33 and the DC/DC converters 35.

The DC/DC converters 35 are arranged in the vicinity of the integrated circuit board connector 33. The DC/DC converters 35 are a step-down section to step down the first electrical signals transmitted via the high potential electrical wiring line 34. The step-down methods are not particularly limited.

The electrical signals stepped down by the DC/DC converter 35 are supplied to the integrated circuit 30. The integrated circuit 30 is operated according to external control signals from the HDMI connector 32 and electrical signals from the DC/DC converters 35. For example, the integrated circuit 30 is driven by the electrical signals, and outputs the control signals according to the external control signals.

The through hole group 36 is electrically connected to the integrated circuit 30 disposed on the front surface of the integrated circuit board 14. The signal line connector 37 is electrically connected to the integrated circuit 30 via the though hole group 36. Further, the signal line connector 37 is electrically connected to the signal line connector 25 on the electrical wiring board 11 as shown in FIG. 4, and functions as an output section for outputting the control signals from the integrated circuit 30 to the signal line connector 25 on the electrical wiring board 11. In this embodiment, while the signal line connector 25 and the signal line connector 37 form a B-to-B connector, other kinds of connectors may be used.

In the integrated circuit board 14, a plurality of screw holes 39 penetrating from the front surface to the rear surface of the integrated circuit board 14 are formed. The screw holes 39 are used for grounding the integrated circuit substrate 14 via screws (not shown).

In the above structure, it is desired that the HDMI connector 32 and the integrated circuit board connector 33 are arranged to keep a distance as much as possible. Further, it is preferable that wiring lines electrically connecting the DC/DC converter 35 to the integrated circuit board connector 33 do not intersect with or run in parallel to other lines (for example, a wiring line electrically connecting the HDMI connector 32 to the integrated circuit 30). Further, it is desired that the integrated circuit 30 and the signal line connector 37 are arranged as close to each other as possible. The structure as described above makes possible to reduce the influence of noise on electrical signals, because it is possible to separate a wiring network transmitting low potential electrical signals from a wiring network transmitting high potential electrical signals. Note that, the above term "parallel" means extending adjacently in parallel.

Next, the arrangement of the electrical system of the liquid ejection head 1 is described more in detail below.

Driving signals which are electrical signals for driving the liquid ejecting head 1 are inputted to the electrical wiring board 11. As a power system for transmitting the above driving signals, there are used a low potential power system (a power system for logic control) for controlling various circuits mounted on the electrical wiring board 11 or like others, and a high potential power system (a power system for physical driving) for driving heaters and sub-heaters of the element substrates 10. Therefore, as a connector for inputting operation signals from the body of the liquid ejection apparatus 100, a drawer connector enabling bundling and grouping of a plurality of power systems is desired.

Figure 6:
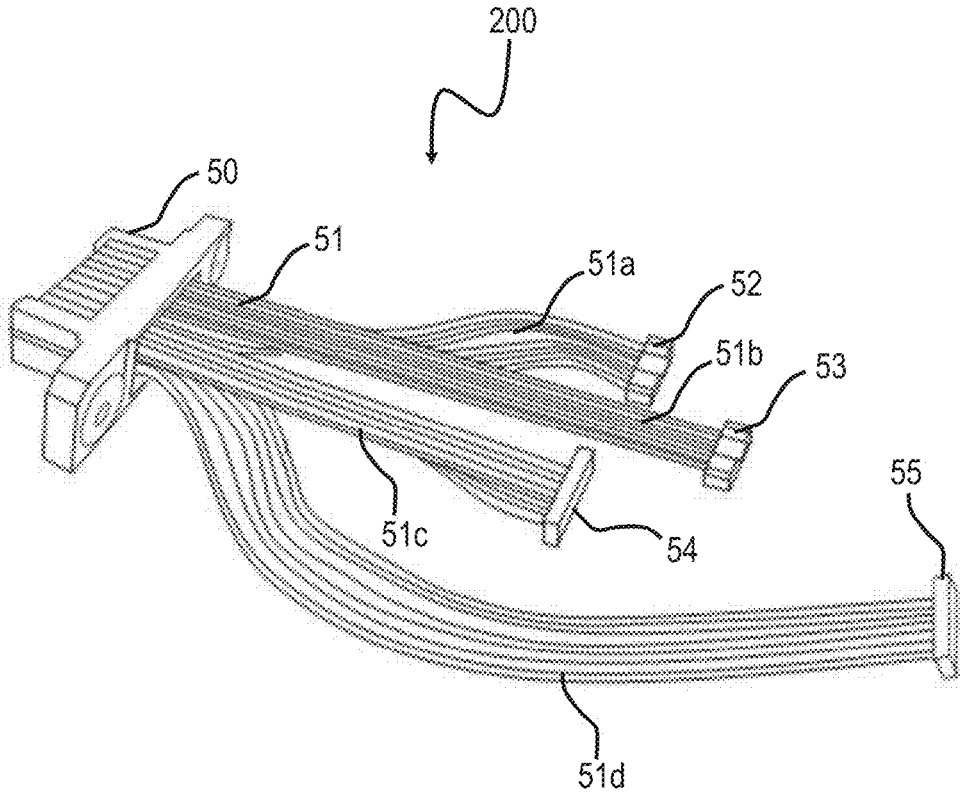
FIG. 6 is a perspective view for illustrating a drawer connector according to the first embodiment of the present disclosure.

FIG. 6 is a perspective view for illustrating an electrical input member having a drawer connector. The electrical input member 200 as shown in FIG. 6 is supported by the connector support section 12*a*.

The electrical input member 200 has a drawer connector 50 and a harness (a bundle of wiring lines) 51, which is a cable connected to the drawer connector 50. The harness 51 is divided into four harnesses 51*a*-51*d* on the opposite side of the drawer connector 50. The terminals 52-55 are arranged at the end portion of each harness (51*a*-51*d*) on the opposite side of the drawer connector 50.

The harnesses 51*a*, 51*b* and 51*d* each are a cable of a high potential power system, that is the first cable for transmitting the first electrical signal of high potential among the operation signals. The terminals 52 and 53 disposed at the end portions of the harnesses 51*a* and 51*b* are connected to the electrical wiring board connectors 22 and 23 of the electrical wiring board 11, respectively. The electrical signals transmitted via the harnesses 51*a* and 51*b* are used for driving a heater and a sub-heater of the element substrate 10.

The terminal 55 disposed at the end portion of the harness 51*d* is connected to the integrated circuit substrate connector 33 of the integrated circuit board 14. The electrical signals transmitted via the harness 51*d* are used for driving a circuit such as the integrated circuit 30 disposed on the integrated circuit board 14.

The harness 51*c* is a cable of a low potential power system, that is, the second cable for transmitting the second electrical signals among the operation signals. The terminal 54 disposed at the end portion of the harness 51*c* is connected to the electrical wiring board connector 24 of the electrical wiring board 11. The electrical signals transmitted via the harness 51*d* are used to control a circuit such as a logic circuit (not shown) mounted on the electrical wiring board 11.

Potential of the second electrical signals is lower than that of the first electrical signals. In this embodiment, the potential of the first electrical signals is 15V or more (not lower than 15V), and the potential of the second electrical signal is less than 10V (lower than 10V).

Note that, since the integrated circuit 30 is to be driven at a low potential, the first electric signals supplied to the electrical circuit board connector 33 are supplied to the integrated circuit 30 after being stepped down using the DC/DC converters 35 disposed on the integrated circuit board 14 as described above. When low potential electric signals are supplied to the integrated circuit substrate connector 33, such low potential electrical signals may fluctuate by the influence of electromagnetic induction caused by electric signals of high potential supplied to the electrical wiring board 11. Therefore, in this embodiment, by elevating the potential of the electric signals supplied to the integrated circuit board connector 33, fluctuations in electric signals are reduced.

Figure 7A:
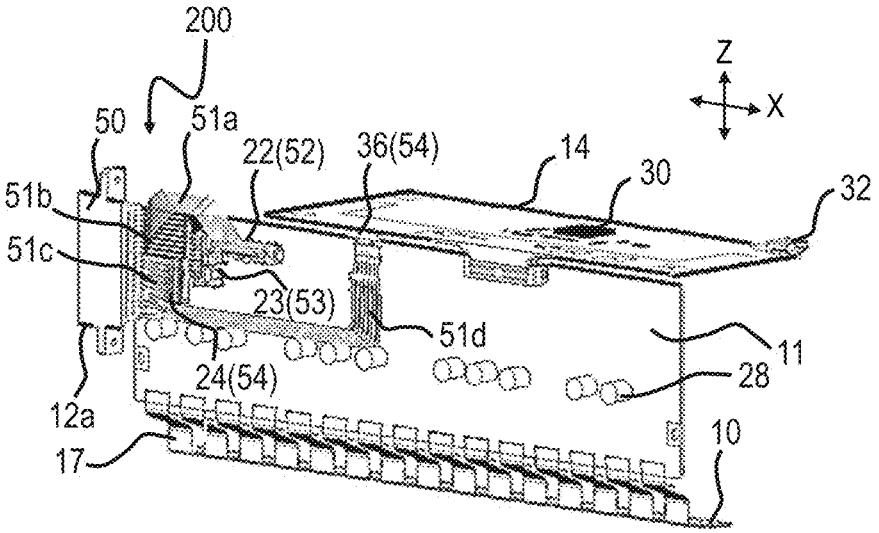
FIG. 7A is a view for illustrating a harness according to the first embodiment of the present disclosure.
Figure 7B:
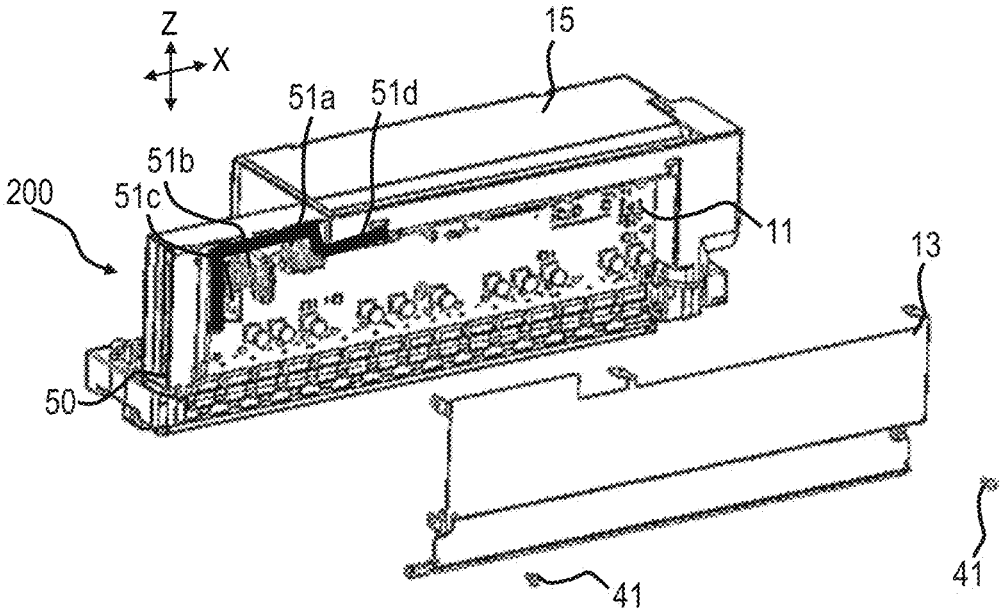
FIG. 7B is a view for illustrating a harness according to the first embodiment of the present disclosure.
Figure 8:
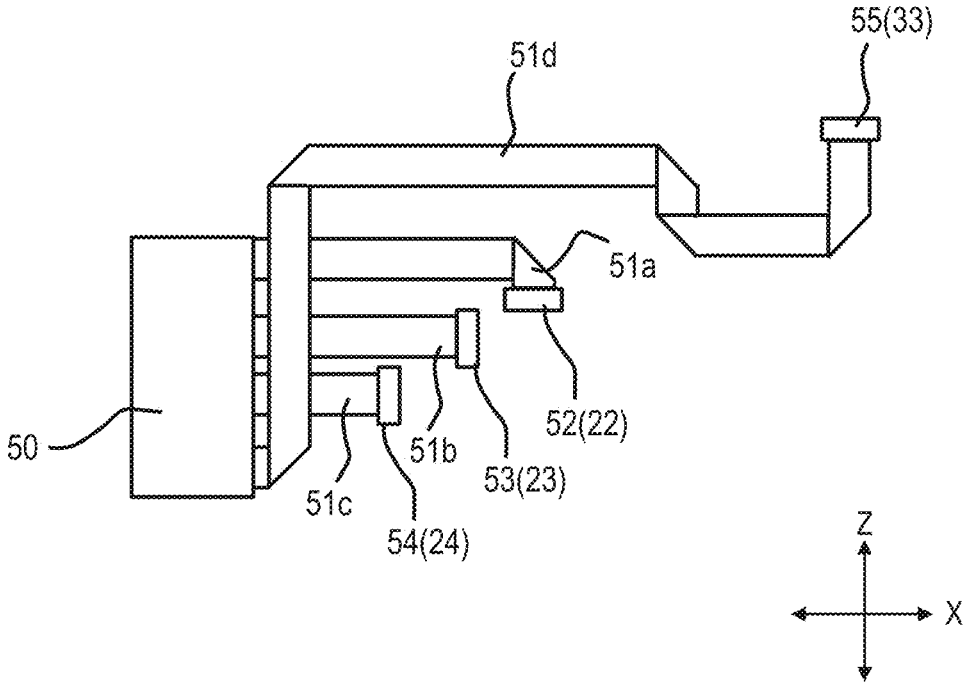
FIG. 8 is a pattern diagram for illustrating the arrangement of a harness according to the first embodiment of the present disclosure.

FIGS. 7A and 7B and FIG. 8 are views for illustrating the connection and arrangement (layout) of the harnesses 51*a*-51*d* of the liquid ejection apparatus 100.

FIG. 7A shows the connection relation of the harnesses 51*a*-51*d*. As shown in FIG. 7A, the electrical input member 200 having a drawer connector 50 is supported by the connector support section 12*a* of the support member 12 and the drawer connector 50 is electrically connected to the body of the liquid ejection apparatus 100. Further, the HDMI connector 32 of the integrated circuit 14 is electrically connected to the body of the liquid ejection apparatus 100.

As shown in FIG. 7A, the terminal 52 disposed at the end portion of the harness 51*a* extending from the drawer connector 50 is connected to the electrical wiring board connector 22 of the electrical wiring board 11. The terminal 53 disposed at the end portion of the harness 51*b* is connected to the electrical wiring board connector 23 of the electrical wiring board 11. The terminal 54 disposed at the end portion of the harness 51*c* is connected to the electrical wiring board connector 24 of the electrical wiring board 11. The terminal 55 disposed at the end portion of the harness 51*d* is connected to the electrical wiring board connector 33 of the electrical wiring board 14.

FIG. 7B shows the arrangement of the harnesses 51*a*-51*d*. FIG. 8 is a view for illustrating schematically the arrangement of the harnesses 51*a*-51*d*. As shown in FIGS. 7B and 8, the harnesses 51*a*-51*c* extend substantially in parallel in the predetermined direction (in this embodiment, X direction which is substantially horizontal direction, i.e. the longitudinal direction of the electrical wiring board 11) from the drawer connector 50.

The harness 51*d* is arranged such that it does not run in parallel to the harness 51*c*. Specifically, the harness 51*d* runs in the direction substantially orthogonal to the harness 51*c* (in the Z direction which is the vertical direction, i.e. the transverse direction of the electrical wiring board 11). By this structure, it is possible to reduce the influence on the electrical signals of low potential transmitted via the harness 51*c* caused by the electrical signals of high potential transmitted via the harness 51*d*. Further, the harness 51*d* runs to the upper surface of the electrical wiring board 11 in the substantially Z direction. Thereafter, the harness 51*d* is arranged to run substantially along the X direction on the upper of the electrical wiring board 11 to the position where it is connected to the integrated circuit board connector 33. Thereby, the harness 51*d* is also arranged such that it does not run in parallel to the harnesses 51*a* and 51*b*. Therefore, it is desired that the harness 51*d* is longer than the harness 51*c*. Further, it is desired that among the electrical wiring board connectors 22-24, the electrical wiring board connector 24 connected to the terminal 54 of the harness 51*c* is arranged in the position closest to the drawer connector 50.

The first wiring lines (not shown) transmitting the first electrical signals and the second wiring lines (not shown) transmitting the second electrical signals in the electrical wiring board 11 are arranged such that they do not run in parallel to each other. Note that the first wiring line is disposed such that the first electrical signals are transmitted to the lower layer through the through hole (not shown) immediately after the first electrical signals are inputted to the electrical wiring board connectors 22 and 23, and thereafter disposed so as to be transmitted to the surface layer in the vicinity of the electrolytic capacitor 28. The electrolytic capacitors 28 are disposed side by side along the X direction in the vicinity of the flexible wiring board 17. As mentioned above, the signal line connector 25 is disposed on the opposite side to the drawer connector 25 and the electrical wiring board connectors 22-24 relative to the center line C extending orthogonally to the X direction, which is the longitudinal of the electrical wiring board 11. In this case, the signal lines 26 on the electrical wiring board 11 can be disposed without contacting them with the harnesses 51*a*-51*c*. Note that, since the harness 51*d* connected to the integrated circuit board connector 33 is also disposed along the upper surface of the electrical wiring board 11, the signal lines 26 are not contacted with the harness 51*d*.

In the embodiment described above, the harness 51 is branched into four harnesses. However, as long as it has a cable of a high potential power system and a cable of a low potential power system, the number of branched harnesses 51 is not limited. Further, though not shown in the drawings, the electrical wiring board 11 may have other circuits such as an operational amplifier or ADC (analogue-to-digital converter) for acquiring a temperature of the element substrate and transmitting it to the integrated circuit 30. It is desired that these circuits are disposed so as not to contact wiring lines through which the high potential first electrical signals are transmitted. Those circuits may be disposed on the integrated circuit board 14 or in the body of the liquid ejection apparatus 100, not on the electrical circuit board 11.

Figure 9:
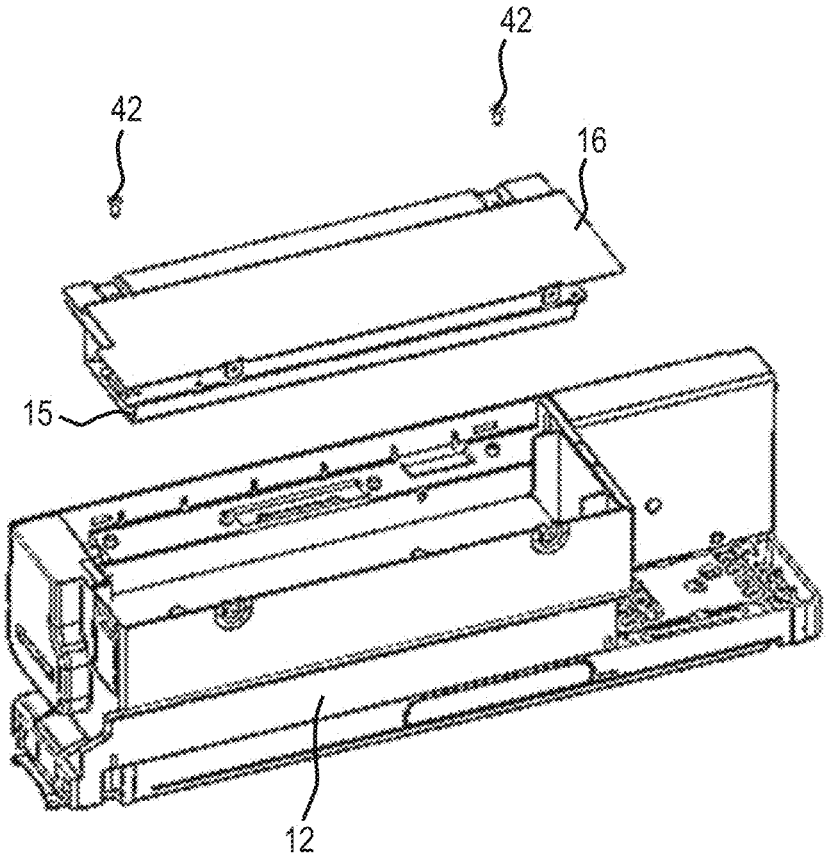
FIG. 9 is a view for illustrating a protective sheet metal according to the first embodiment of the present disclosure.

As shown in FIG. 7B, in the electrical wiring board 11, the protective sheet metal 13 is attached using the screws 41. Thereby, the electrical wiring board 11 is grounded to the protective sheet metal 13 via the screws 41. Further, as shown in FIG. 9, in the integrated circuit board 14, the protective sheet metals 15 and 16 are attached using the screws 42. Thereby, the integrated circuit board 14 is grounded to the protective sheet metals 15 and 16 via the screws 42. In this structure, it is desired that the protective sheet metals 13, 15 and 16 are attached so as to electrically contact with each other. In this case, since all of the electrical wiring board 11, the integrated circuit 14 and the protective sheet metals 13, 15 and 16 are electrically connected to each other, it is possible to secure a wide ground surface and to construct the liquid ejection head 1 as electrically stable.

As described above, according to this embodiment, the electrical wiring board 11 has the signal line connector 25 to which the control signals are inputted, and the electrical wiring board connectors 22-24 to which the electrical signals for operating the liquid ejection head are inputted. The signal line connector 25 and the electrical wiring board connectors 22-24 are disposed on the opposite sides to each other relative to the center line C extending orthogonally to the longitudinal direction of the electrical wiring board 11. Therefore, since the wiring lines for transmitting each of the control signals and the wiring lines for transmitting the electrical signals can be arranged to keep a distance as much as possible, it is possible to reduce disturbance of the waveform of the control signals due to the fluctuation of the electric signals. Therefore, it is possible to reduce the influence of noise on the control signals.

Other Embodiments

FIGS. 10A to 12D are respective views for illustrating other structures of the liquid ejection head 1. Specifically, these drawings are views for illustrating the positional relationship of the electrical wiring board 11 and the integrated circuit board 14 along with some other components.

Figure 10A:
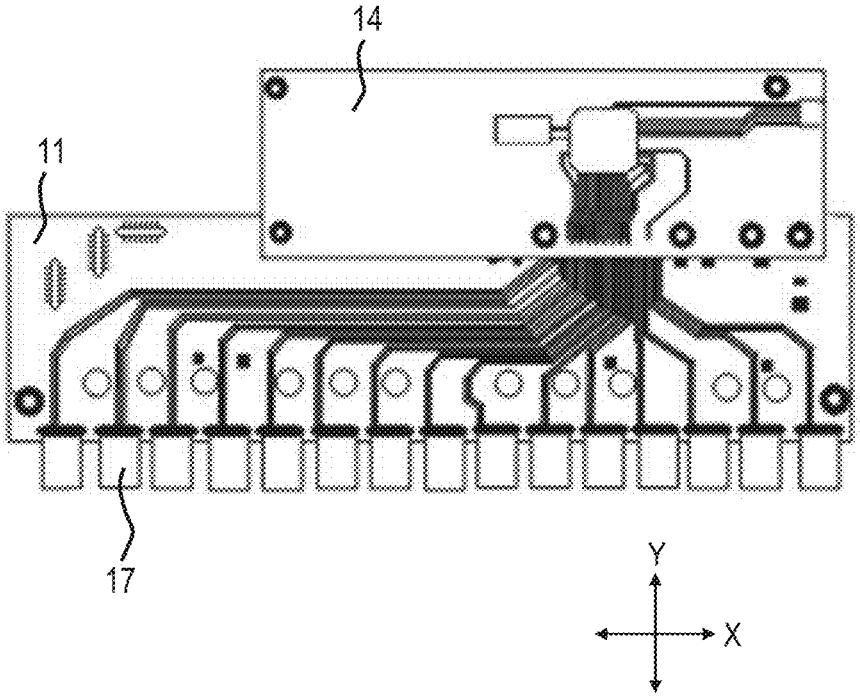
FIG. 10A is a view for illustrating a liquid ejection head according to another embodiment of the present disclosure.
Figure 10B:
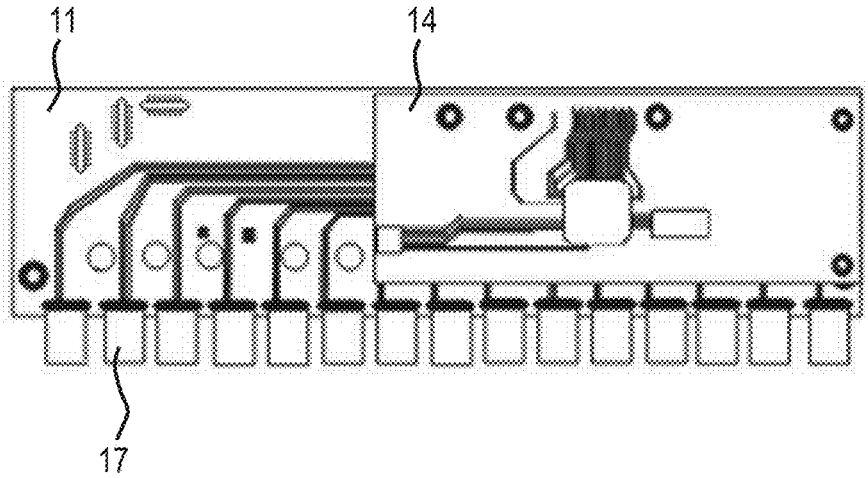
FIG. 10B is a view for illustrating a liquid ejection head according to still another embodiment of the present disclosure.

In the embodiments of FIGS. 10A and 10B, the electrical wiring board 11 and the integrated circuit board 14 are arranged substantially in parallel to each other. In FIG. 10A, as viewed from above, the integrated circuit board 14 protrudes from the electrical wiring board 11 at the opposite side to the side provided with the flexible wiring boards 17. In FIG. 10B, as viewed from above, the integrated circuit board 14 is placed within the electrical wiring board 11.

In FIGS. 11A to 12D, for clearly showing the positional relationship of the electrical wiring board 11 and the integrated circuit board 14, members unnecessary for explaining the positional relationship are omitted. Further, FIGS. 11A to 12D show the liquid ejection head 1 as viewed from the side.

Figure 11A:
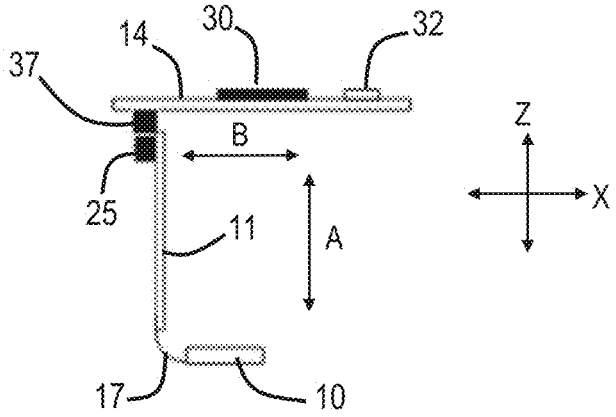
FIG. 11A is a view for illustrating a liquid ejection head according to still another embodiment of the present disclosure.

In the embodiment of FIG. 11A, as in the first embodiment, the electrical wiring board 11 and the integrated circuit board 14 are disposed so as to be substantially orthogonal to each other. However, it is different from the first embodiment in the point that the longitudinal direction A of the electrical wiring board 11 and the longitudinal direction B of the integrated circuit board 14 are disposed so as to be orthogonal to each other.

Figure 11B:
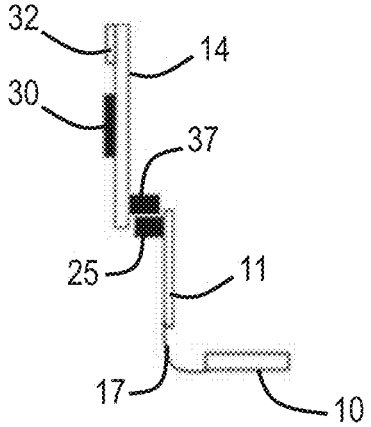
FIG. 11B is a view for illustrating a liquid ejection head according to still another embodiment of the present disclosure.

In the embodiment of FIG. 11B, both of the electrical wiring board 11 and the integrated circuit board 14 are disposed substantially along the vertical direction, and disposed side by side substantially along the vertical direction.

Figure 11C:
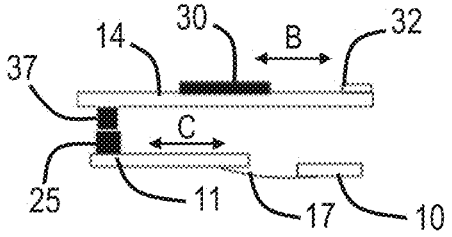
FIG. 11C is a view for illustrating a liquid ejection head according to still another embodiment of the present disclosure.

In the embodiment of FIG. 11C, the electrical wiring board 11 and the integrated circuit board 14 are disposed substantially in parallel to each other, and the transverse direction C of the electrical wiring board 11 and the longitudinal direction B of the integrated circuit board 14 are disposed substantially in parallel. Further, the element substrate 10 is disposed substantially along the horizontal direction, and the electrical wiring board 11 and the element substrate 10 are disposed side by side substantially along the horizontal direction.

Figure 12A:
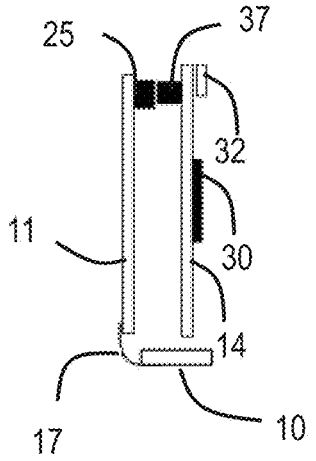
FIG. 12A is a view for illustrating a liquid ejection head according to still another embodiment of the present disclosure.

In the embodiment of FIG. 12A, both of the electrical wiring board 11 and the integrated circuit board 14 are disposed substantially along the perpendicular direction, and the electrical wiring board 11 and the integrated circuit board 14 are disposed side by side so as to face each other substantially along the horizontal direction.

Figure 12B:
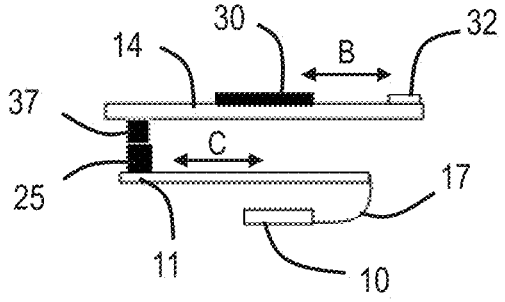
FIG. 12B is a view for illustrating a liquid ejection head according to still another embodiment of the present disclosure.
Figure 12B:
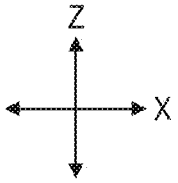

In the embodiment of FIG. 12B, similarly as in the embodiment of FIG. 11C, the electrical wiring board 11 and the integrated circuit board 14 are disposed substantially in parallel to each other, and the transverse direction C of the electrical wiring board 11 and the longitudinal direction B of the integrated circuit board 14 are disposed substantially in parallel to each other. However, the arrangement of the element substrate 10 is different from that in the embodiment of FIG. 11C. Specifically, the element substrate 10 is disposed substantially along the horizontal direction, and the electrical wiring board 11 and the element substrate 10 are disposed side by side substantially in the vertical direction.

Figure 12C:
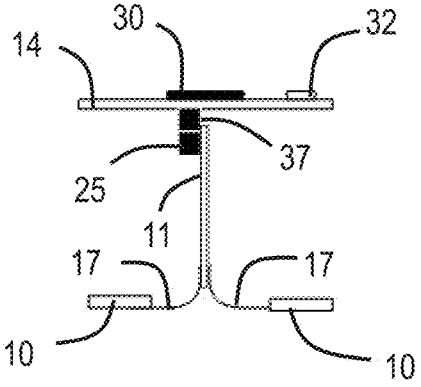
FIG. 12C is a view for illustrating a liquid ejection head according to still another embodiment of the present disclosure.

In the embodiment in FIG. 12C, similarly as in the first embodiment, the electrical wiring board 11 and the integrated circuit board 14 are so as to be substantially orthogonal to each other. However, this embodiment is different from the first embodiment in the point that the electrical wiring board 11 is connected to the integrated circuit board 14 near the center of the integrated circuit board 14. Further, the element substrate 10 is disposed on both sides in the substantially horizontal direction of the electrical wiring board 11 so as to be substantially orthogonal to the electrical wiring board 11.

Figure 12D:
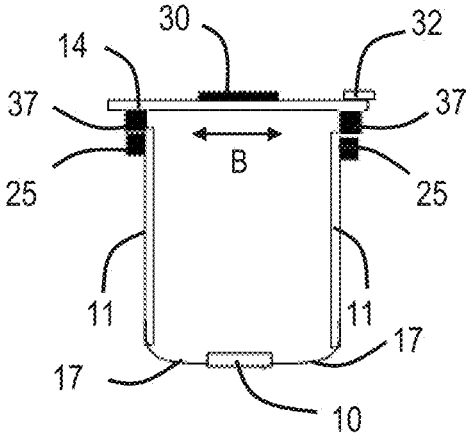
FIG. 12D is a view for illustrating a liquid ejection head according to still another embodiment of the present disclosure.

FIG. 12D shows an embodiment in which a plurality of electrical wiring boards 11 are disposed. Specifically, in the embodiment of FIG. 12D, similarly as in the first embodiment, the electrical wiring board 11 and the integrated circuit board 14 are arranged so as to be substantially orthogonal to each other. However, this embodiment is different from the first embodiment in the point that each of the electrical wiring substrates 11 is connected to both sides on the longitudinal direction B of the integrated circuit board 14. Further, the element substrate 10 is disposed between the two electrical wiring boards 11 in the horizontal direction so as to be connected to both of the electrical wiring boards 11 through the flexible wiring board 17.

The structures as described above are merely the examples. Therefore, as long as disturbance of the waveform of the control signals due to the fluctuation of the electric signals can be reduced, it is possible to select arrangements in other structures. Note that, in a case where a unit such as a scanner is not mounted on the upper portion of the liquid ejection apparatus 100, it is not required that the integrated circuit board 14 be disposed so as to be substantially orthogonal to the electrical wiring board 11.

In each embodiment as described above, the structures as shown in the figures are merely the examples. Therefore, the present disclosure is not limited to such structures.

For example, it is not required that the liquid ejection apparatus 100 is a recording apparatus of a page-wide type, but a recording apparatus of a serial type may be also selected. Each of connectors such as the HDMI connector 32 as described in each of the embodiments is merely an example, and the present disclosure is not limited thereto.

According to the present disclosure, since the wiring lines for transmitting each of control signals and electric signals can be arranged at positions separated from each other, it is possible to reduce disturbance of the waveform of the control signals due to the fluctuation of the electric signals. Therefore, it is possible to reduce the influence of noise on control signals.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131776, filed Jul. 5, 2017, which is hereby incorporated by reference herein in its entirety.

What is claimed is:

1. A liquid ejection head comprising:

an element substrate for ejecting a liquid;

an integrated circuit board including an integrated circuit configured to output a control signal for controlling the element substrate; and an electrical wiring board connected electrically to the element substrate, wherein the electrical wiring board includes a signal input section to which the control signal is inputted, and a power input section to which an electric signal for driving the liquid ejection head is inputted, and wherein the signal input section and the power input section are disposed on opposite sides to each other relative to a center line extending orthogonally to a longitudinal direction of the electrical wiring board.

2. The liquid ejection head according to claim 1, further comprising an electrical input member having a plurality of cables including a cable connected to the power input section and a connector connected to the plurality of cables, wherein the plurality of cables include a first cable for transmitting a first electric signal as the electric signal, and a second cable for transmitting a second electric signal having a lower electrical potential than the first electric signal.

3. The liquid ejection head according to claim 2, wherein the first cable and the second cable are disposed such that they do not run in parallel with each other.

4. The liquid ejection head according to claim 3, wherein the first cable and the second cable are disposed such that they run orthogonally to each other.

5. The liquid ejection head according to claim 2, wherein the first cable is connected to the integrated circuit board, and the second cable is connected to the power input section.

6. The liquid ejection head according to claim 5, wherein the first cable is longer than the second cable.

7. The liquid ejection head according to claim 5, wherein the integrated circuit board has a connection section connected to the first cable and an output section for outputting the control signal, and the connection section is disposed between the connector and the output section in a longitudinal direction of the integrated circuit board.

8. The liquid ejection head according to claim 7, wherein the integrated circuit board has a step-down section for stepping down the first electric signal transmitted via the first cable, and the integrated circuit is driven by the first electric signal stepped down in the step-down section.

9. The liquid ejection head according to claim 8, wherein a wiring line electrically connecting the connection section and the step-down section does not intersect with any other wiring lines.

10. The liquid ejection head according to claim 7, wherein the integrated circuit board has an external input section to which an external control signal is inputted, the integrated circuit outputs the control signal from the output section according to the external control signal, and the external input section and the connection section are disposed on opposite sides to each other relative to the integrated circuit.

11. The liquid ejection head according to claim 2, wherein the connector is a drawer connector.

12. The liquid ejection head according to claim 2, wherein the first electric signal has an electrical potential of not lower than 15V, and the second electric signal has an electrical potential of lower than 10V.

13. The liquid ejection head according to claim 1, wherein the liquid ejection head is of a page-wide type, and a plurality of element substrates are disposed along a longitudinal direction of the liquid ejection head.

14. The liquid ejection head according to claim 13, wherein the plurality of element substrates are arranged in line.

* * * * *